US005332042A

United States Patent [19]

Walter et al.

[11] Patent Number: 5,332,042

[45] Date of Patent: Jul. 26, 1994

[54] FLUID CONTROL VALVE

[75] Inventors: Jeffrey S. Walter; Kenneth D. Caskey; Clinton W. Cole, all of Duncan, Okla.

[73] Assignee: Halliburton Company, Duncan, Okla.

[21] Appl. No.: 780,676

[22] Filed: Oct. 21, 1991

[51] Int. Cl.[5] ..... E21B 34/06

[52] U.S. Cl. ..... 166/321; 137/516.25; 166/319; 166/325

[58] Field of Search ..... 166/321, 319, 325, 320; 137/515, 515.5, 516.25, 516.27, 516.29

[56] References Cited

U.S. PATENT DOCUMENTS

| | | | |
|---|---|---|---|
| 2,431,769 | 12/1947 | Parker | 137/516.27 X |
| 2,771,091 | 11/1956 | Baker et al. | 137/516.29 X |
| 2,854,929 | 10/1958 | McGowen et al. . | |
| 2,888,080 | 5/1959 | Tausch et al. | 166/192 |
| 2,912,000 | 11/1959 | Green | 137/516.29 X |
| 3,054,422 | 9/1962 | Napolitano | 137/516.27 X |
| 3,385,370 | 5/1968 | Knox et al. | 137/515 |
| 3,601,191 | 8/1971 | McMurry et al. | 166/319 |
| 3,698,411 | 10/1972 | Garrett | 166/325 X |
| 3,738,436 | 6/1973 | Litchfield et al. | 175/218 X |
| 3,847,223 | 11/1974 | Scott et al. | 166/305 R |
| 3,967,679 | 7/1976 | Liljestrand | 175/218 X |
| 4,274,490 | 6/1981 | Huckaby | 166/325 |
| 4,399,871 | 8/1983 | Adkins et al. | 166/325 |
| 4,586,569 | 5/1986 | Hyde | 166/317 |
| 4,957,167 | 9/1990 | Schultz | 166/319 |

*Primary Examiner*—Hoang C. Dang
*Attorney, Agent, or Firm*—James R. Duzan

[57] ABSTRACT

A fluid flow control valve having an adjustable opening pressure and using expendable components therein for use in pumping highly abrasive fluids therethrough.

11 Claims, 4 Drawing Sheets

FLUID CONTROL VALVE

BACKGROUND OF THE INVENTION

This invention relates to a fluid flow control valve for use with highly abrasive fluids in low fluid level wells.

In many operations performed in wells it is desired to pump fluids down through a string of tubing or conduit into a subsurface formation intersected by the well bore. In many such operations it is desirable to be able to control the flow of fluids in the string of tubing for a wide variety of purposes by placing a valve therein.

In many areas wells contain weak formations which will allow unlimited fluid flow thereinto unless the flow of the fluid is controlled. These weak formations typically will accept the flow of fluid in a tubing string due to the hydrostatic pressure of the fluid column in the tubing string without any pressure increase from pumping operations.

In these instances, a valve is used in the string of tubing at a point therein near the weak formation to control the flow of fluid from the string of tubing. Typically, these valves can be preset to open and close at specific tubing pressures to allow control over the pumping of fluids into the weak formation.

Typical prior art valves used in string of tubing are shown in U.S. Pat. Nos. 2854929, 2888080, 3847223, 4274490, 4399871, 4586569, and 4957167. While these types of valves are satisfactory for controlling the flow of fluids pumped into a well, when pumping highly abrasive fluids through the valves, various parts of the valve can be easily abraded thereby causing the valve to have either diminished flow control ability or to lose control of fluid flow completely.

SUMMARY OF THE INVENTION

The present invention relates to a fluid flow control valve for use with highly abrasive fluids in low fluid level wells. The fluid flow control valve of the present invention comprises a valve having an adjustable opening pressure and uses expendable components therein while maintaining fluid flow control capability for use in pumping highly abrasive fluids therethrough.

The present invention will be better understood when the drawings are taken in conjunction with the following detailed description of the invention.

DESCRIPTION OF THE INVENTION

Figure 1:
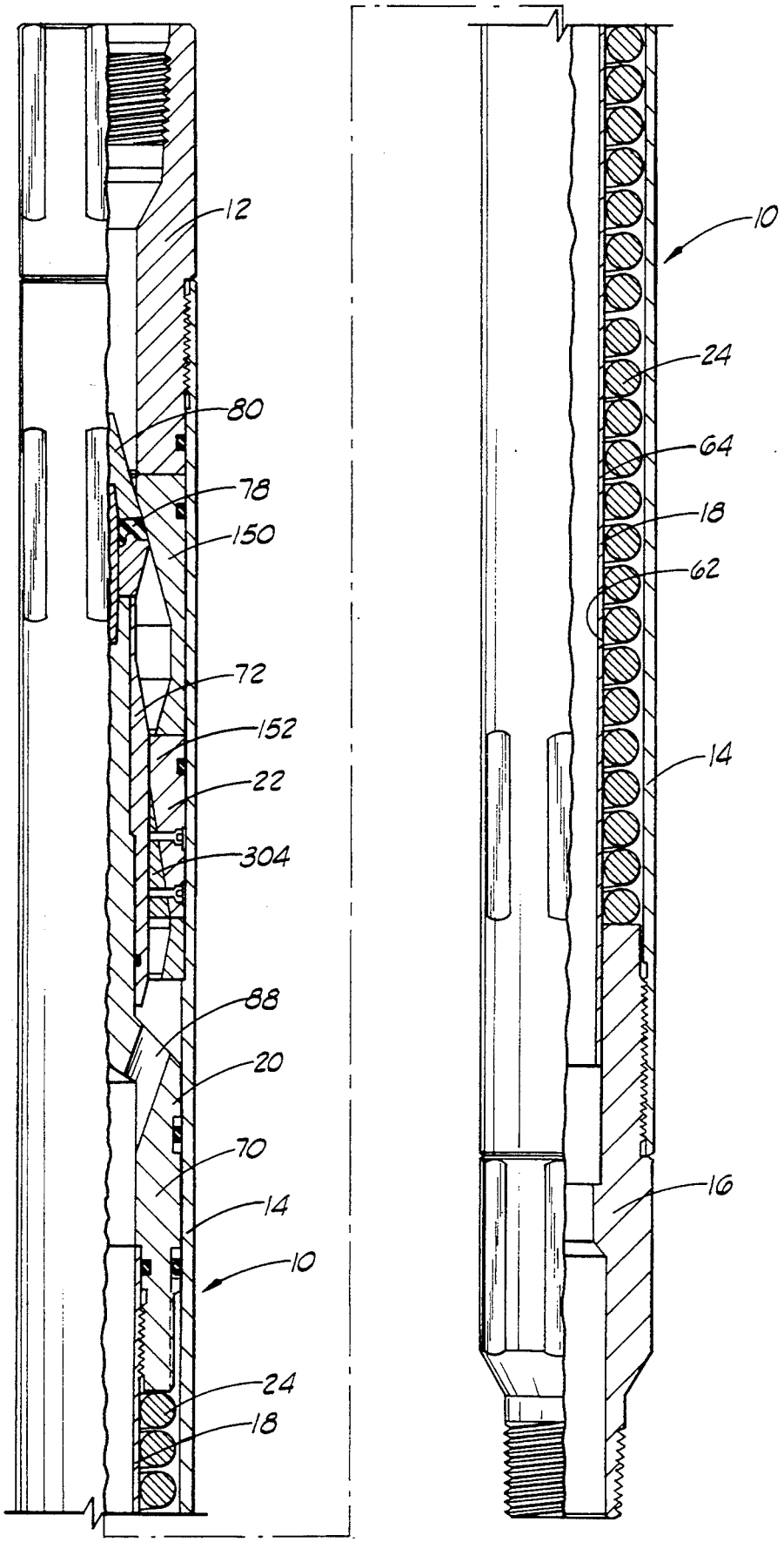
FIG. 1 is a quarter-sectional view of the fluid flow control valve of the present invention.

Referring to FIG. 1, the fluid flow control valve 10 of the present invention is shown. The fluid flow control valve 10 comprises an upper adapter 12, valve case 14, lower adapter 16, valve mandrel 18, valve piston assembly 20, valve seat assembly 22, and spring 24.

Figure 2:
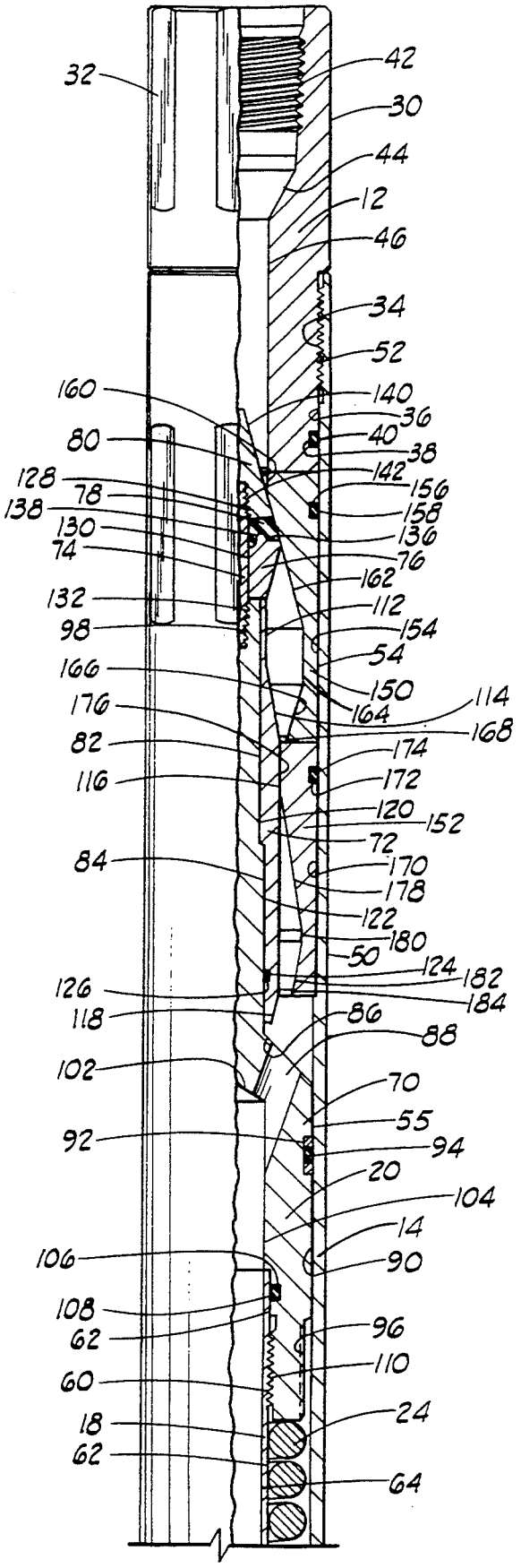
FIG. 2 is a quarter-sectional view of an upper portion of a first embodiment of the fluid flow control valve of the present invention.

Referring to drawing FIG. 2, the upper portion of a first embodiment of the fluid flow control valve 10 is shown.

The upper adapter 12 comprises an elongated annular cylindrical member having, on the exterior thereof, first surface 30 having, in turn, wrenching flats 32 thereon, threaded surface 34, and second surface 36 having, in turn, annular recess 38 therein containing annular elastomeric seal 40 and, on the interior thereof, threaded bore 42, frusto-conical annular bore 44 and bore 46.

Figure 4:
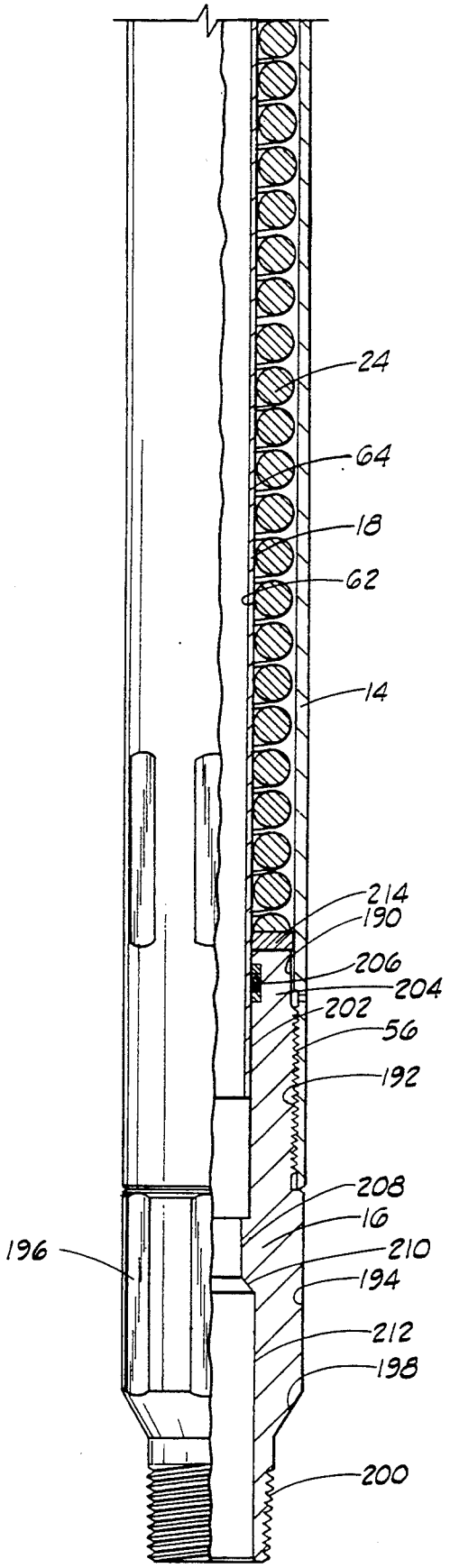
FIG. 4 is a quarter-sectional view of a lower portion of the fluid flow control valve of the present invention.

The valve case 14 comprises an elongated annular cylindrical member having exterior surface 50 and, on the interior, first threaded bore 52 which releasably threadedly engages threaded surface 34 on upper adapter 12, first bore 54 which has, in turn, a portion sealingly engaging annular elastomeric seal 40, second bore 55, and second threaded bore 56 (see FIG. 4).

The valve mandrel 18 comprises an elongated annular member having, on the exterior thereof, threaded surface 60 and surface 62 and, on the interior thereof, bore 64.

The valve piston assembly 20 comprises valve piston 70, interior expendable valve seal 72, valve stem 74, valve shoe 76, valve seal 78 and valve head 80. Interior expendable valve seal 72 may be referred to as a first sacrificial component 72.

Valve piston 70 comprises an elongated annular cylindrical member having, on the exterior thereof, first surface 82, second surface 84, frusto-conical annular surface 86 having, in turn, a plurality of apertures 88 therethrough, third surface 90 having, in turn, annular recess 92 therein containing annular seal 94 therein and fourth surface 96 and, on the interior thereof, first threaded bore 98, frusto-conical annular surface 102, blind bore 104 having, in turn, annular recess 106 therein containing annular elastomeric seal 108 therein, and second threaded bore 110 which releasably threadedly engages threaded surface 60 of valve mandrel 18.

The interior expendable valve seal 72 comprises an annular cylindrical member having, on the exterior thereof, first surface 112, first frusto-conical annular surface 114, second surface 116 and second frusto-conical annular surface 118 and, on the interior thereof, first bore 120 and second bore 122 having, in turn, annular recess 124 containing annular elastomeric seal 126 therein.

Valve stem 74 comprises a cylindrical member having, on the exterior thereof, first threaded surface 128, and surface 130 and second threaded surface 132 which releasably threaded engages first threaded bore 98 of valve piston 70.

The valve shoe 76 comprises an annular cylindrical member having an annular lug 136 on the upper end thereof.

The valve seal 78 comprises an annular elastomeric member having an annular recess 138 on one end thereof which mates with annular shoulder 136 of valve shoe 76.

The valve head 80 comprises a cylindrical member having frusto-conical annular surface 140 and threaded bore 142 therein which releasably threadedly engages first threaded surface 128 of valve stem 74.

The valve seat assembly 22 comprises valve seat 150 and exterior expendable valve seat 152. Valve seat 150 may also be referred to as primary valve seat 150. Exterior expendable valve seat 152 may also be referred to as a second sacrificial member 152.

The valve seat 150 comprises an annular cylindrical member having, on the exterior thereof, surface 154 having, in turn, annular recess 156 therein containing annular elastomeric seal 158 which sealingly engages bore 54 of valve case 14 and, on the interior thereof, first bore 160, first frusto-conical annular surface 162, second bore 164, second frusto-conical annular surface 166 and third bore 168.

The exterior expendable valve seat 152 comprises an annular cylindrical member having, on the exterior thereof, surface 170 having, in turn, annular recess 172 therein containing annular elastomeric seal 174 which sealingly engages bore 54 of valve case 14 and, on the interior thereof, first bore 176, first frusto-conical annular surface 178, second bore 180, second frusto-conical annular surface 182 and third bore 184. The first bore 176 of external expendable valve seat 152 closely slidably engages and receives the second surface 116 of interior expendable valve seal 72. When piston assembly 20 moves downward relative to seat assembly 22, the cylindrical second surface 116 moves out of engagement with bore 176 and an annular throttling flow are is created between frusto-conical surface 114 of interior expendable valve seal 72 and frusto-conical surface 176 of exterior expendable valve seat 152. This annular flow area will be the most restricted flow area through valve 10 and thus will be where the fluid flow reaches its highest velocity and the most wear occurs. The first frusto-conical annular surface 176 of exterior expendable valve seat 152 may also be referred to as a downwardly diverging tapered enlarged diameter bore 178. The first frusto-conical annular surface 114 of interior expendable valve seal 72 may also be referred to as a reduced diameter upwardly converging tapered outer surface thereof.

The spring 24 comprises an annular helically wound coil type spring as a resilient biasing means to bias the valve piston assembly in an initially closed position and when open, towards a closed position.

Figure 3:
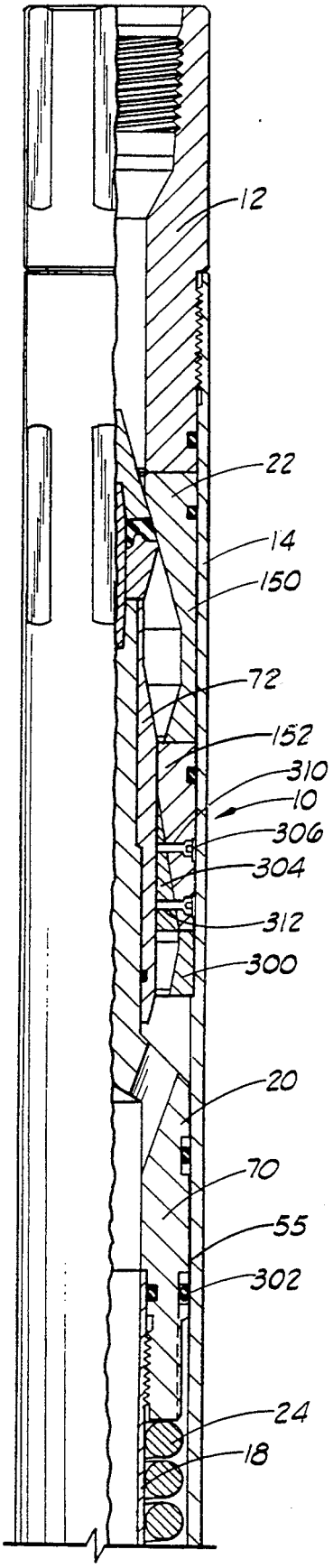
FIG. 3 is a quarter-sectional view of an upper portion of a second embodiment of the fluid flow control valve of the present invention.

Referring to drawing FIG. 3, the upper portion of a second preferred embodiment of the fluid flow control valve 10 is shown.

The fluid flow control valve 10 is shown in drawing FIG. 3 is the same as that shown and described hereinbefore with respect to drawing FIG. 2 except for exterior expendable valve seat 152, the addition of a separate diffuser 300 to the valve seat assembly 22, and the addition of back-up seals 302 located on the exterior of the valve piston 70 sealingly engaging second bore 55 of valve case 14.

The exterior expendable valve seat 152 shown in drawing FIG. 3 includes a plurality of stabilizing fingers 304 which abut interior expendable valve seal 72 of piston assembly 20 when the piston 70 is in its open or closed position. The stabilizing fingers 304 are secured to the exterior expendable valve seat 152 by a plurality of threaded fasteners 306 which are installed in apertures 310 of seat 152 extending into apertures 312 of fingers 304.

Referring to drawing FIG. 4, the lower adapter 16 is shown.

The lower adapter 16 comprises an elongated annular cylindrical member having, on the exterior thereof, first surface 190, first threaded surface 192 which releasably threadedly engages second threaded bore 56 of valve case 14, second surface 194 having wrenching flats 196 therein, frusto-conical annular surface 198 and second threaded surface 200 and, on the interior thereof, first bore 202 having, in turn, annular recess 204 containing annular seal 206 therein which slidingly sealingly engages surface 62 of valve mandrel 18, second bore 208, frusto-conical annular surface 210 and third bore 212.

If desired, one or more annular spring shims or spacers 214 can be inserted between the spring 24 and lower adapter 16 to control the opening and closing pressure of the valve piston assembly 20.

OPERATION OF THE INVENTION

Referring to drawing FIG. 1, the operation of the preferred embodiment of fluid flow control valve 10 of the present invention is described as follows. The fluid flow control valve 10 is assembled into a string of tubing and the tubing is run into a well bore with the valve 10 being located near the formation of interest.

As desired, fluid is pumped down the string of tubing to the fluid flow control valve 10. When the fluid reaches the valve 10, it is prevented from flowing therethrough as the valve piston assembly 20 blocks fluid flow through the valve seat assembly 22 by the valve head 80 and valve seal 78 sealingly engaging valve seat 150 of valve seat assembly 22. The valve piston assembly 20 blocks flow until the restoring force of spring 24 is exceeded. At this time, valve piston assembly 20 moves downwardly in valve case 14 to allow fluid flow past valve head 80 and valve seal 78, through the annular space created between valve head 80 and valve seal 78 and valve seat assembly 22, through apertures 88 in valve piston 70, through bore 64 of valve mandrel 18 and through lower adapter 16 into the remainder of the string of tubing, if any. Upon cessation of pumping the spring 24 will close the valve piston assembly 20 in valve seat assembly 22.

Since interior expendable valve seal 72 of piston assembly 20 and exterior expendable valve seat 152 of valve seat assembly 22 are designed as sacrificial members, highly abrasive fluids can be pumped through fluid flow control valve 10 and substantially only seal 72 and seat 152 will be abraded by the highly abrasive fluid. After completion of the work pumping the highly abrasive fluid, the fluid flow control valve 10 can be removed from the well bore, disassembled, and interior expendable valve seal 72 of valve piston assembly 20 and exterior expendable valve seat 152 of valve seat assembly 22 replaced to return the valve 10 to service. By including specifically designed parts of the fluid flow control valve 10 as sacrificial members the maintenance and repair of the valve 10 can be simplified. Also, by adding shims or spacers 214 (see FIG. 4) between the spring 24 and lower adapter 16 the opening pressure of the valve piston assembly 20 can be controlled and over stressing of the spring 24 can be controlled. Additionally, by including valve seal 78 in the valve piston assembly 20 as the seal 72 and seat 152 are abraded, the valve seal 78 will continue to engage seat 150 as the valve piston assembly 20 closes to prevent the flow of fluid through the fluid flow control valve 10.

By using the stabilizer fingers 304 on the exterior expendable valve seal 152 when the piston 70 is in its open position the finger 304 help to stabilize the piston assembly 20 within the valve case 14. It should also be noted by moving the high velocity fluid flow point to the annular fluid flow area between the interior expendable valve seal 72 and exterior expendable valve seat 152, little erosion of the valve seal 78, valve head 80 and valve seat 150 should occur during the flow of highly abrasive fluid through the fluid flow control valve 10 thereby maintaining an effective valve seal 78 and valve seat 150 upon the closure of the piston assembly 20 in the fluid flow control valve 10.

It is understood that changes and modifications that come within the scope of the invention can be made by those of ordinary skill in the art and are intended to be within the scope of the invention.

Having thus described the invention, we claim:

1. A fluid flow control valve for use in a well bore having a string of conduit therein, said valve to control the flow of fluids through said string of conduit into said well bore, said fluid flow control valve comprising:

a valve case adapted to be connected to said string of conduit in said well bore so that fluid flowing down through said string of conduit flows through said fluid flow control valve;

a valve piston assembly located in a portion of the valve case, the valve piston assembly including a first sacrificial component to be worn away by said flow of fluids through said string of conduit and through said fluid flow control valve while the remaining components of the valve piston assembly remain substantially free of wear by said flow of fluids;

a valve seat assembly located in a portion of the valve case, the valve seat assembly surrounding a portion of the valve piston assembly and including a second sacrificial component to be worn away by said flow of fluids through said conduit string and through said fluid flow control valve while the remaining components of the valve seat assembly remain substantially free of wear, said second sacrificial component being operatively associated with said first sacrificial component to define a flow path therebetween when said valve is open; and a resilient biasing spring to bias the valve piston assembly in an initial closed position having a portion thereof contacting a portion of the valve seat assembly and to bias the valve piston assembly towards the closed position when forced open by said flow of fluids through said string of conduit and through said fluid flow control valve.

2. The fluid flow control valve of claim 1 further comprising:

an upper adapter connected to the upper end of the valve case to connect said fluid flow control valve to said string of conduit;

a lower adapter connected to the lower end of the valve case; and a valve mandrel connected to a portion of the valve piston assembly.

3. The fluid flow control valve of claim 1 wherein the valve seat assembly comprises:

a primary valve seat retained within the valve case; and an exterior expendable valve seat to closely engage a portion of the valve piston assembly, said exterior expendable valve seat being said second sacrificial component.

4. A fluid flow control valve for use in a well bore having a string of conduit therein, said valve to control the flow of fluids through said string of conduit into said well bore, said fluid flow control valve comprising:

an upper adapter to connect said fluid flow control valve to said string of conduit;

a valve case having one end thereof connected to the upper adapter;

a valve piston assembly located in a portion of the valve case, the valve piston assembly comprising:

a valve piston having a plurality of apertures therein;

an interior expendable valve seal disposed about a portion of the valve piston above the plurality of apertures therein;

a valve stem connected to one end of the valve piston;

a valve shoe disposed about the valve stem;

an elastomeric valve seal disposed about the valve stem adjacent the valve shoe; and a valve head disposed about the valve stem adjacent the valve seal;

a valve seat assembly located in a portion of the valve case surrounding a portion of the valve piston assembly, the valve seat assembly comprising:

a primary valve seat retained within the valve case to sealingly engage said elastomeric valve seal; and an exterior expendable valve seat to closely engage said interior expendable valve seal;

a valve mandrel connected to a portion of the valve piston assembly;

a resilient biasing spring to bias the valve piston assembly in an initially closed position contacting a portion of the valve seat assembly and to bias the valve piston assembly towards the closed position when forced open by said flow of fluids through said string of conduit and through said fluid flow control valve, the resilient biasing spring being located in a portion of the valve case surrounding a portion of the valve mandrel; and a lower mandrel connected to the other end of the valve case and having a portion contacting the resilient biasing spring.

5. A fluid flow control valve for use in a well bore having a string of conduit therein, said valve to control the flow of fluids through said string of conduit into said well bore, said fluid flow control valve comprising:

a valve case adapted to be connected to said string of conduit in said well bore;

a valve piston assembly located in a portion of the valve case, the valve piston assembly including a component thereof to be worn away by said flow of fluids through said string of conduit and through said fluid flow control valve while the remaining components of the valve piston assembly remain substantially free of wear by said flow of fluids to thereby control said flow of fluids therethrough;

a valve seat assembly located in a portion of the valve case, the valve seat assembly surrounding a portion of the valve piston assembly and including a component thereof to coact with the component of the valve piston assembly to be worn away by said flow of fluids through said fluid flow control valve, the component of the valve seat assembly to be worn away by said flow of fluids through said conduit string and through said fluid flow control valve while the remaining components of the valve seat assembly remain substantially free of wear to thereby control said flow of fluids therethrough;

a resilient biasing spring to bias the valve piston assembly in an initial closed position having a portion thereof contacting a portion of the valve seat assembly and to bias the valve piston assembly towards the closed position when forced open by said flow of fluids through said string of conduit and through said fluid flow control valve; and wherein the valve piston assembly includes:

a valve piston;

an interior expendable valve seal disposed about a portion of the valve piston, said interior expendable valve seal being said component of said valve piston assembly to be worn away;

a valve stem connected to the valve piston;

a valve shoe disposed about the valve stem;

a valve seal disposed about the valve stem adjacent the valve shoe; and a valve head disposed about the stem adjacent the valve seal.

6. The fluid flow control valve of claim 5 wherein the valve seat assembly comprises:

a primary valve seat disposed within said valve case and arranged to sealingly engage said valve seal and a portion of said valve head of the valve piston assembly when said valve is in said closed position; and an exterior expendable valve seat adapted to closely engage said interior expendable valve seal when said valve is in said closed position, said exterior expendable valve seat being said component of said valve seat assembly to be worn away.

7. A fluid flow control valve for use in a well bore having a string of conduit therein, said valve to control the flow of fluids through said string of conduit into said well bore, said fluid flow control valve comprising:

an upper adapter to connect said fluid flow control valve to said string of conduit;

a valve case having one end thereof connected to the upper adapter;

a valve piston assembly located in a portion of the valve case;

a valve seat assembly located in a portion of the valve case surrounding a portion of the valve piston assembly;

a valve mandrel connected to a portion of the valve piston assembly;

a resilient biasing spring to bias the valve piston assembly in an initially closed position contacting a portion of the valve seat assembly and to bias the valve piston assembly towards the closed position when forced open by said flow of fluids through said string of conduit and through said fluid flow control valve, the resilient biasing spring being located in a portion of the valve case surrounding a portion of the valve mandrel;

a lower adapter connected to the other end of the valve case and having a portion contacting the resilient biasing spring; and wherein said valve piston assembly includes:

a valve piston having a plurality of apertures therein;

an interior expendable valve seal disposed about a portion of the valve piston above the plurality of apertures therein;

a valve stem connected to one end of the valve piston;

a valve shoe disposed about the valve seat;

an elastomeric valve seal disposed about the valve seal adjacent the valve shoe; and a valve head disposed about the valve stem adjacent the valve seal.

8. The fluid flow control valve of claim 7 wherein the valve seat assembly comprises:

a primary valve seat disposed within said valve case and arranged to sealingly engage said valve seal and a portion of said valve head of the valve piston assembly when said valve is in said closed position; and an exterior expendable valve seat adapted to closely engage said interior expendable valve seal when said valve is in said closed position.

9. A fluid flow control valve for use in a well bore having a string of conduit therein, comprising:

a valve case adapted to be connected to said string of conduit so that fluid flowing down through said string of conduit flows through said valve case;

a valve seat assembly disposed in said valve case, said valve seat assembly including:

a primary valve seat; and an exterior expendable valve seat located below said primary valve seat, said exterior expendable valve seat being separable from said primary valve seat so that said exterior expendable valve seat can be replaced without replacing said primary valve seat;

a valve piston assembly disposed in said valve case, said valve piston assembly including:

a primary valve sealing member adapted to sealingly engage said primary valve seat; and an interior expendable valve seal located below said primary valve sealing member and operatively associated with said exterior expendable valve seat to define a flow path therebetween when said valve is open so that erosion of said valve due to said fluid flowing therethrough occurs primarily on said exterior expendable valve seat and said interior expendable valve seal, said interior expendable valve sealing member being separable from said primary valve sealing member so that said interior expendable valve sealing member can be replaced without replacing said primary valve sealing member; and a resilient biasing spring arranged to bias said valve piston assembly toward a closed position of said valve wherein said primary valve sealing member engages said primary valve seat.

10. The valve of claim 9, wherein:

said exterior expendable valve seat includes a cylindrical bore defined therein and an enlarged diameter bore located below said cylindrical bore;

said interior expendable valve seal includes a cylindrical outer surface which is closely received in said cylindrical bore of said exterior expendable valve seat when said valve is in its said closed position, and said interior expendable valve seal includes a reduced diameter outer surface located above said cylindrical outer surface; and said exterior expendable valve seat and said interior expendable valve seal being so arranged and constructed that when said valve is in its said open position, said cylindrical outer surface of said interior expendable valve seal is located below said cylindrical bore of said exterior expendable valve seat and said reduced diameter outer surface of said interior expendable valve seal and said enlarged diameter bore of said exterior expendable valve seat define an annular throttling fluid flow are therebetween at which said fluid reaches its highest velocity when flowing through said valve.

11. The valve of claim 10, wherein:

said enlarged diameter bore of said exterior expendable valve seat is a downwardly diverging tapered bore; and said reduced diameter outer surface of said interior expendable valve seal is an upwardly converging tapered outer surface.

* * * * *